United States Patent [19]

Tremblay

[11] Patent Number: 4,953,571

[45] Date of Patent: Sep. 4, 1990

[54] ASH TRAYS

[75] Inventor: Raymond Tremblay, Montreal, Canada

[73] Assignee: Les Entrepôts Dupont et Lanctot Inc., St. Constant, Canada

[21] Appl. No.: 358,409

[22] Filed: May 30, 1989

[51] Int. Cl.[5] ..... A24F 19/02; A24F 19/14

[52] U.S. Cl. ..... 131/231; 131/235.1; 131/240.1

[58] Field of Search ..... 131/235.1, 236, 174, 131/231, 240.1, 242

[56] References Cited

U.S. PATENT DOCUMENTS 2,919,701 1/1960 Aghnides ..... 131/235.1

3,920,028 11/1975 Kobayakawa ..... 131/236

*Primary Examiner*—Vincent Millin

*Assistant Examiner*—J. L. Doyle

*Attorney, Agent, or Firm*—Lespërance, Pierre

[57] ABSTRACT

An ash tray consisting of three containers, embedded in one another. The intermediate container is held spacedly above the centrally-bored bottom wall of the outer container, by frictional interengagement of the side walls thereof, whereby ventilation is facilitated between the walls of these latter two containers. There is a plurality of small, cigarette-engaging compartments between the inner and intermediate containers. The top edge portion of the inner container supports an upturned, radially-inturned open ring having a few radial channels, for supporting lighted cigarettes. The cigarettes may be extinguished by engagement in one of the small compartments.

6 Claims, 2 Drawing Sheets

ASH TRAYS

FIELD OF THE INVENTION

This invention relates to ash trays.

BACKGROUND OF THE INVENTION

A disadvantage of known ash trays is that, when the smoker extinguishes a cigarette by crushing the burning end thereof against the flat bottom wall of the ash tray, if the cigarette is not completely spent and should the smoker wish to light and use for a second time that same cigarette, the "taste" thereof will have been unfavorably altered, as is well known by smokers. Also, when a burning cigarette temporarily staying on an ash tray is "forgotten", it tends to pivot by itself due to its progressive shortening and may fall off the ash tray, causing burning and fire.

OBJECTS OF THE INVENTION

One goal of the invention is to provide an ash tray which will allow extinguishing of a cigarette without having to crush its burning end.

Another goal of the present invention is to provide an ash tray which will be able to support a lighted cigarette while positively preventing accidental falling of the cigarette off the ash tray.

SUMMARY OF THE INVENTION

In accordance with the above-mentioned objects of the invention, there is disclosed an ash tray comprising a bowl and a bottomless cup fitted within said bowl. The bowl defines an upwardly-outwardly diverging side wall and a bottom wall. The cup defines an upwardly-outwardly extending side wall having a bottom edge resting on the bowl bottom wall, a plurality of winglets radially-outwardly-projecting from said cup side wall, the radially-outward edge of said small winglets conforming to the shape of said bowl and snugly fitting therewithin, whereby a plurality of small compartments are defined between the bowl and the cup side walls and between each pair of successive winglets; a cigarette being engageable in any selected one of said compartments, for extinguishing the same; said cup further including a ring-like member, radially-inwardly extending from the top edge thereof and defining cigarette supporting means.

Advantageously, an outer shell is provided having a side wall and a bottom wall and into which is fitted said bowl; said bowl bottom wall being upturned; the upper edge portion of said bowl side wall supported by said shell wall, whereby the bowl bottom wall is spaced from said shell bottom wall; the latter having a central bore, whereby ventilation is facilitated between the outer shell and the bowl.

Profitably, the lower portion of said bowl side wall includes a few small upturned bulges, each extending into one of said small compartments; said bulges forming stoppers, to prevent rotation of said cup relative to said bowl.

The cigarette supporting means could include a few spaced radially-extending depressions or "channels", made on the top face of said ring-like member.

Preferably, the top face of said ring-like member is convex in cross-section. Preferably also, the lower portion of said bowl side wall forms a concave section defining a groove surrounding said bowl bottom wall.

DETAILED DESCRIPTION OF THE PREFERRED EMBODIMENT OF THE INVENTION

Figure 1:
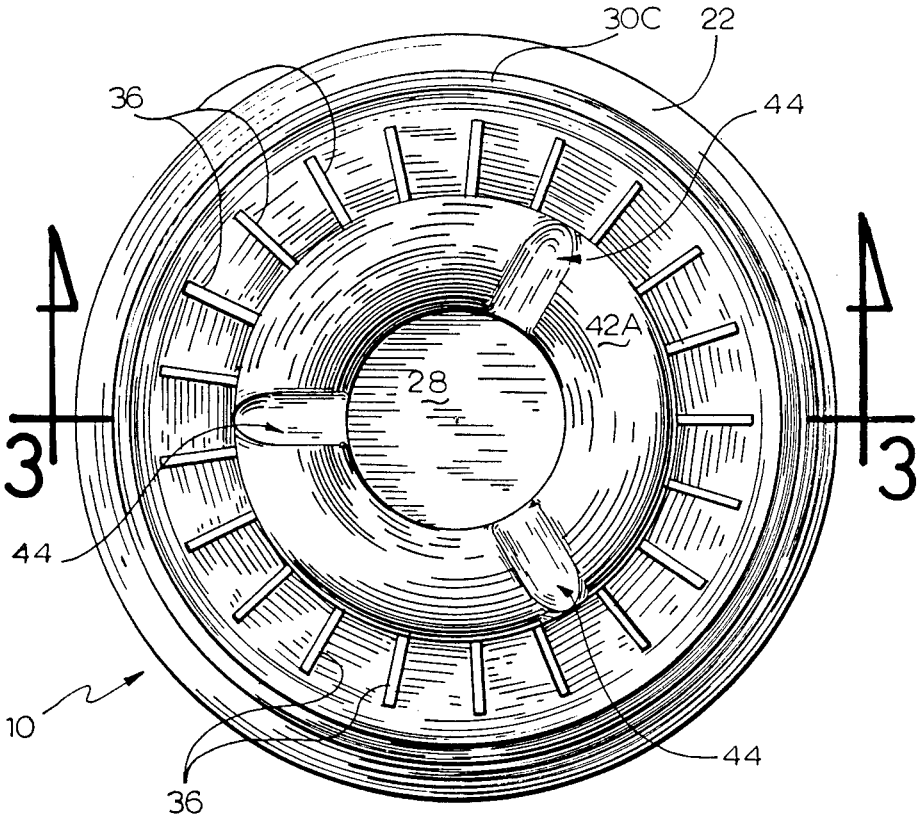
FIG. 1 is a top plan view of an ash tray according to a preferred embodiment of the invention.
Figure 2:
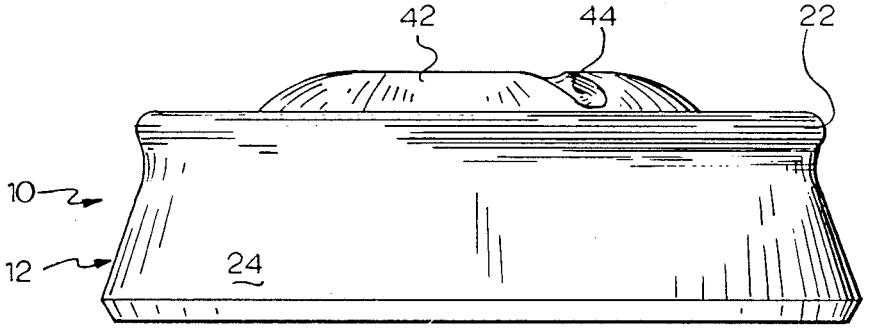
FIG. 2 is a side elevational view thereof.

The ash tray 10 includes a circular outer shell 12, into which is engaged a bowl 14, the bowl in turn supporting a central cup member 16. Ash tray 10 is designed to be used for supporting and/or extinguishing cigarettes C.

Shell 12 consists of a circular flooring 18 having an upwardly-outwardly curved peripheral integral wall 20. The inner face of wall 20 has a slight concavity. The top edge of the outer face of wall 20 forms an annular bulge 22. Also, an annular flange 24 downwardly depends from the intermediate section of the outer face of wall 20. Flange 24 is slightly outwardly (downwardly) inclined, and its intermediate section 24A is thicker. The peripheral edge portion of flooring 18 includes a downturned annular bulge, 18A, wherein the bottom face thereof, at 18B, is coplanar to the bottom face of exterior flange 24, at 24B. Hence, spaced annular faces 18B, 24B, constitute the supporting base of the ash-tray 10, designed to flatly abut against a horizontal surface such as counter T. Flooring 18 is thinner than side wall 20 and includes a central ventilating bore 26.

Bowl 14 defines a circular flat flooring 28 and is provided with a peripheral side wall 30. The latter includes at its lower portion a concave portion forming a groove 32 surrounding flooring 28. Side wall 30 defines a lower half 30A which has a slight concavity with respect to the interior of the bowl, and an upper half 30B, which is substantially straight, the upper edge of section 30B being outwardly curved at 30C.

Cup 16 is bottomless and forms a circular upwardly-outwardly-inclined wall 34, the bottom edge of which rests in groove 32. A plurality of partition walls or winglets 36 project radially-outwardly from wall 34. The top edge 36A of each partition 36 is upwardly convex. The radially-outer side and bottom edges of partitions 36 define a vertical shape which conforms with and abuts the interior face of bowl 14 including part of groove 32. Hence, upraised flooring 28 of bowl 14 somewhat slightly projects within the volume defined by the walls 34 of cup 16. Small compartments 37 are thus defined between of walls 30 and 34.

Advantageously, there may be a few (e.g. three as shown) small inturned bulges 38, projecting from the bottom of groove 32. Bulges 38 constitute stop members, preventing rotation of cup 16 relative to bowl 14, since each extends between a given pair of partitions 36.

Profitably, the central bore 26 made into flooring 18 enables ventilation between floorings 18 and 28 and between side walls 20 and 30, there being a space between floorings 18 and 28 because shell 12 supports cup 16 at the top edge 30C of the latter.

An important feature of the invention is the provision of a ring-like member 42 radially-inwardly-projecting from and removably snap-fitted on the top edge of wall 34. Ring member 42 defines an upwardly-extending convex portion 42A merging into a downturned annular wall portion 42B. Ring member 42 is bottomless, i.e. that it constitutes in fact half of a substantially circular shape in cross-section. Ring convex portion 42A includes a few (e.g. three as shown) equally-distributed radial depressions 44. Both radial ends 44A, 44B, of each depression 44 are downwardly curved, while the main section thereof at 44C is horizontal (i.e. parallel to the plane defined by faces 18B and 24B).

Preferably, permanent magnets 46 and 48, in the form of a flexible disc and strips respectively, are fixed under the flooring 28 of bowl 14 and under member 42 with the like poles oppositely directed. Parts 14 and 42 are preferably made of steel, while the remaining parts are made of plastic.

Figure 3:
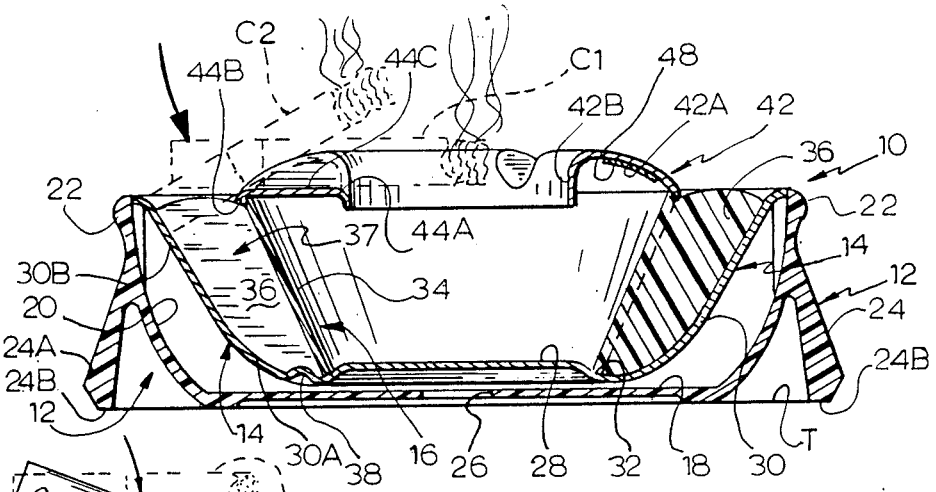
FIG. 3 is a cross-sectional view taken along line 3—3 of FIG. 1, and showing in dotted lines the fag-end of a cigarette in different tipped up positions.
Figure 3A:
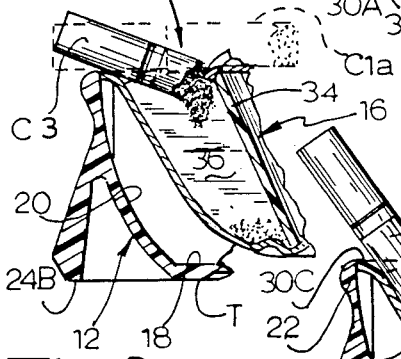

Ash tray 10 is used as follows. Firstly, ash tray 10 is designed to support a lighted cigarette C: the cigarette is horizontally placed on one of the channel members 44, at $C_1$ in FIG. 3, with its burning end B in vertical register with the central opening of the ring-like member 42. The ashes are allowed to fall on flooring 28 of bowl 14 within the volume defined by circular wall 34. Upon progressive consumation of the cigarette, the length of the cigarette shortens and the center of gravity is accordingly displaced lengthwisely thereof, i.e. radially-outwardly of wall 34. Thus, the cigarette C will have a tendency to pivot from a horizontal position $C_1$, backwardly about rounded edge 44B, to a position $C_2$ in FIG. 3, where the butt of the cigarette will engage a compartment 37. If the burning cigarette is initially placed in a channel 44 with its butt end protruding from shell 12, it will pivot downwardly into compartment 37 upon shortening, as suggested at $C_3$. In both cases, the lighted cigarette is positively prevented from falling off the ashtray when left unattended.

Figure 4:
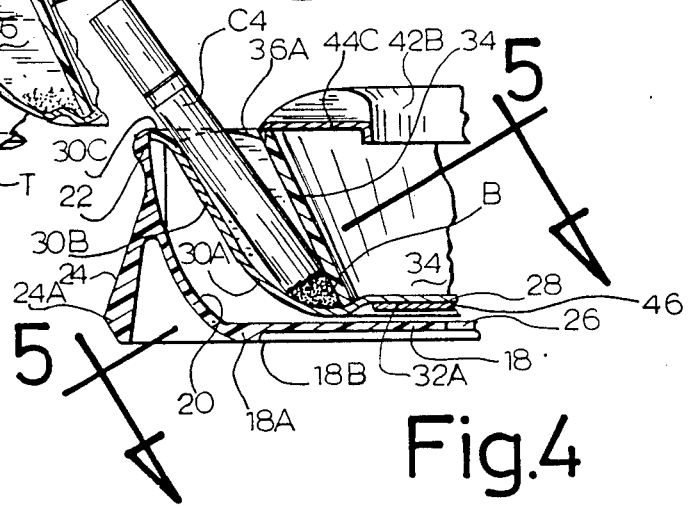
FIG. 4 is a view of the left-hand side of FIG. 3.
Figure 5:
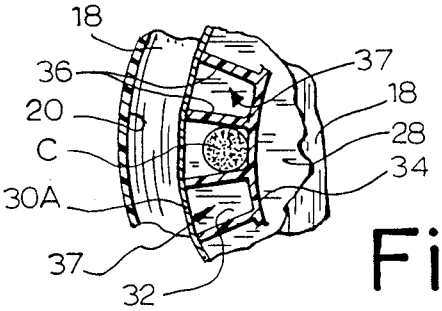
FIG. 5 is a fragmentary cross-sectional view taken along line 5—5 of FIG. 4.

When it is desired to extinguish the cigarette, the latter is engaged into one cavity 37, at $C_4$ in FIG. 4. Because the spacing between two adjacent winglets 36 at their portion adjacent wall 34 is about equal to the diameter of a cigarette and because the bottom section of each compartment 37 is somewhat frusto-conical in shape, the cigarette will become extinguished by exhaustion of air, without the crushing of its burning end. Hence, if the cigarette is used a second time, the smoker will not have to support the unpleasant perspective of smoking a crushed butt, which taste is known by smokers to be of much less appeal.

Since ambient air will engage through bore 26 to flow between the walls of the outer shell 12 and bowl 14, outer shell 12 will never become hot, striking out an inconvenience of prior art ash trays. The various parts of the ash tray can be easily taken apart for cleaning, and can be easily reassembled.

It has been found that the magnetic field produced by and between permanent magnets 46 and 48 causes the smoke from a burning cigarette in position C1 (FIG. 3) to flow down into the cup 16 and to disappear at least in part. The explanation of this phenomenon is not as yet available.

I claim:

1. An ash tray comprising a bowl and a bottomless cup fitted within said bowl; said bowl defining an upwardly-outwardly-diverging side wall having an upper edge section and a bottom wall, said cup defining an upwardly-outwardly extending side wall having a top edge and a bottom edge resting on the bowl bottom wall, a plurality of winglets radially, outwardly projecting from said cup side wall, the radially-outward edge of said winglets conforming to the shape of said bowl and snugly fitting therewithin, whereby a plurality of small compartments are defined between the bowl and the cup side walls and between each pair of successive winglets; a cigarette being engageable in any selected one of said compartments, for extinguishing the same; said cup further including a ring-like member, radially, inwardly extending from the top edge thereof and defining cigarette supporting means; further including an outer shell having a side wall and a bottom wall and into which is fitted said bowl; said bowl bottom wall being upturned; the upper edge portion of said bowl side wall supported by said shell side wall, whereby the bowl bottom wall is spaced from said shell bottom wall; the latter having a central bore, whereby ventilation is facilitated between the outer shell and the bowl.

2. An ash tray as in claim 1, wherein said bowl side wall defines a lower portion including a few small upturned bulges, each extending into one of said small compartments, said bulges forming stoppers, to prevent rotation of said cup relative to said bowl.

3. An ash tray as in claim 1, wherein said cigarette supporting means includes a few spaced radially-extending depressions or "channels", made on the top face defined by said ring-like member.

4. An ash tray as in claim 3, wherein the top face of said ring-like member is convex in cross-section.

5. An ash tray as in claim 4, wherein said lower portion of said bowl side wall forms a concave section defining a groove surrounding said bowl bottom wall.

6. An ash tray as defined in claim 1, wherein said bowl and said ring-like member are made of steel and said cup is made of plastic, and further including permanent magnets fixed to said ring-like member and to said bowl bottom wall and having facing surfaces of the same polarity.

* * * * *